US006482056B1

(12) United States Patent
Schell-Tomczak et al.

(10) Patent No.: US 6,482,056 B1
(45) Date of Patent: Nov. 19, 2002

(54) ENGINE MOUNT

(75) Inventors: Linda Schell-Tomczak, Fenton; Kevin Huff; Anthony J. Seconsky, both of Oswosso, all of MI (US)

(73) Assignee: Maurell Products, Inc., Owosso, MI (US)

( * ) Notice: Subject to any disclaimer, the term of this patent is extended or adjusted under 35 U.S.C. 154(b) by 0 days.

(21) Appl. No.: 09/641,061

(22) Filed: Aug. 17, 2000

(51) Int. Cl.[7] ..... B63H 5/125
(52) U.S. Cl. ..... 440/53; 248/641
(58) Field of Search ..... 440/53; 248/640, 248/641; 114/61.1, 61.22

(56) References Cited

U.S. PATENT DOCUMENTS 2,950,699 A * 8/1960 Ogden et al.
3,210,783 A * 10/1965 Petty ..... 114/61.22
3,289,226 A * 12/1966 Thompson
3,750,988 A * 8/1973 Lyon
5,259,331 A * 11/1993 Hagan ..... 440/66
2002/0046688 A1 * 4/2002 Schell-Tomczak et al. 114/61.1

OTHER PUBLICATIONS

Crest Catalogue, 1997, 32 pp.

* cited by examiner

*Primary Examiner*—Sherman Basinger
(74) *Attorney, Agent, or Firm*—Welsh & Katz, Ltd.

(57) ABSTRACT

An adjustable engine mount for a pontoon boat makes it possible to adjust the relative position of an outboard engine relative to the waterline of the boat. The mount has an elongated, tapered, four-sided body which is attached to the bottom of the hull of the boat by a pair of spaced apart, elongated mounting rails. The body is a substantially U-shaped, continuously changing cross section with an engine-mounting wall located adjacent the stern of the boat. The bow end of the body is pivotably attached to the mounting rails. The stem ends of the rails have a plurality of vertically disposed bolt holes. The vertical position of the body can be adjusted by selecting which vertically disposed bolt holes in the rails to use.

14 Claims, 4 Drawing Sheets

ENGINE MOUNT

FIELD OF THE INVENTION

The invention pertains to mounts for outboard engines. More particularly, the invention pertains to adjustable mounts intended for use with pontoon boats.

BACKGROUND OF THE INVENTION

Pontoon boats include a pair of elongated pontoons which support a platform spanning between the pontoons. An outboard engine or outboard motor (terms used interchangeably) is supported from the platform at a position intermediate the pontoons at a rear of the boat.

An engine mount is connected to an underside of the platform. The engine mount comprises an elongated hollow body or trough which extends longitudinally and rearwardly of the rear end (stern end) of the platform. The body is exposed to the water beneath the boat. The engine mount is substantially closed except for a top opening at a rear of the boat. A fuel tank is held within the body, accessed through the top opening. The outboard motor is bolted to the rear wall of the body. The prior known mount is non-adjustably fixed to the platform. No range of vertical adjustment for the outboard engine is provided by the mount.

The present inventors have recognized that it would be desirable to provide a vertical adjustability at the engine mount such that outboard engines could be optimized for depth below waterline. Additionally, the present inventors have recognized the desirability of providing a vertical adjustability at the engine mount so that a variety of commercially available outboard engines can be attached to the boat, and the boat tuned to the engine by adjusting the depth of the motor beneath the waterline.

SUMMARY OF THE INVENTION

An adjustable engine mount is provided that includes a tapered, elongated body which is couplable to, and vertically adjustable relative to, the hull of a watercraft. The body has a first, smaller end oriented toward the bow of the watercraft and a second, wider end positioned adjacent to the stem of the craft. An engine-mounting wall or mounting plate is attached to the second end of the body. An outboard motor or outboard engine can be attached to the mounting plate. By vertically adjusting the body with respect to the hull, the elevation of the outboard motor with respect to the watercraft or with respect to the waterline, can be adjusted. The adjustment can be utilized to optimize performance of an outboard motor. The adjustment provides flexibility for the use of different model outboard motors on the watercraft.

In one aspect of the invention, the body is substantially hollow and extends rearwardly from a back edge of the watercraft, defining a top opening. An elongated fuel tank can be placed within the body to be connected by a fuel line to the outboard motor. By having an elevation-adjustable body, access for installing and removing the fuel tank is improved. The body can be lowered to provide more clearance for maneuvering the fuel tank partially beneath the back edge of the watercraft.

In another aspect, the body can be formed with a multi-sided, generally U-shaped cross section. The planar sides are tapered and extend smoothly without protrusions between the ends.

Two exterior elongated rails or supports, rigidly coupled to the craft, extend axially therealong and provide support for the body. The body is attached to the rails at a plurality of longitudinal positions between the bow end and stem end of the craft.

In another aspect, the rails, at the stem end, can include a plurality of spaced apart bolt holes or, alternately, protrusions. The stern end of the body can be releasably locked into a selected vertical position by using bolts that extend through the holes, or alternately by using holes which receive the protrusions.

An engine can be coupled to the mounting plate. The mounting plate will in turn support the engine at the vertical position relative to the craft.

In yet another aspect, the body can be formed with four planar tapered sides. Two of the sides extend generally parallel to one another along and beneath the craft. In this embodiment, the mounting plate extends between the parallel sides generally perpendicular thereto.

In a further aspect of the invention, the braces can include a bottom flange having a downturned lip which acts as a splash guard to help prevent water from splashing into the engine mount body.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
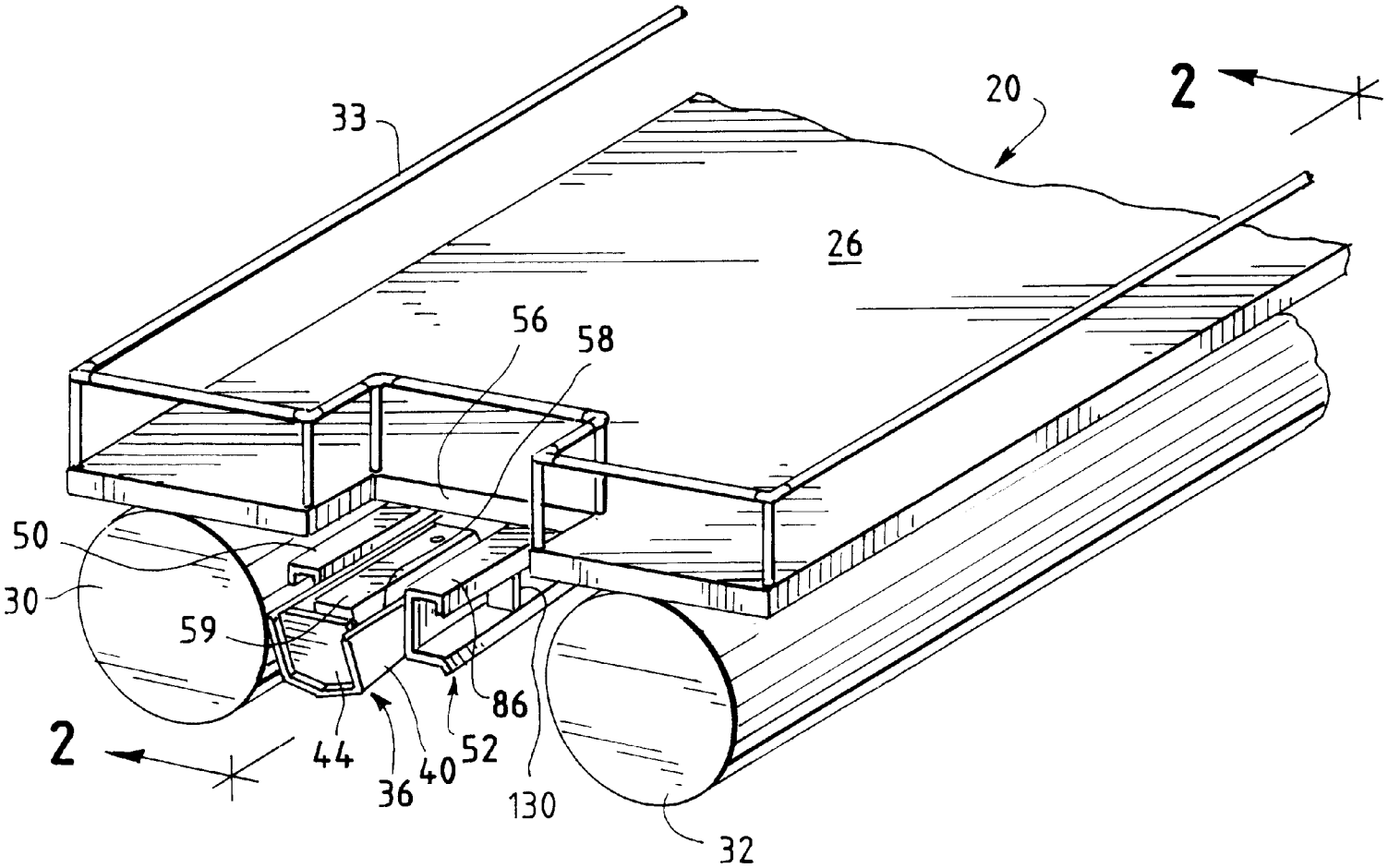
FIG. 1 is a perspective view of a watercraft utilizing the engine mount of the present invention, wherein an outboard motor is not shown for clarity of view of the engine mount.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

FIG. 1 illustrates a watercraft 20. The watercraft 20 includes a platform 26 supported on parallel pontoons 30, 32. For simplicity, the platform is shown as a plain floor surrounded by a railing, but the platform could be adapted to provide seating for people, or storage for cargo, or structure for a houseboat, as only a few examples. Mounted to the platform 26, between the pontoons 30, 32, is an elongated engine mount 36. The engine mount 36 includes a trough-like hollow body 40, closed at a rear end (stem end) by an engine-mounting wall or plate 44. An outboard motor is coupled to the wall 44 as described below. The body 40 is connected intermittently along its length to support rails 50, 52. The support rails 50, 52 are connected intermittently along lengths thereof to an underside of the platform 26. The engine mount 36 extends rearwardly of a back edge 56 of the platform 26, defining a top opening 58.

Figure 2:
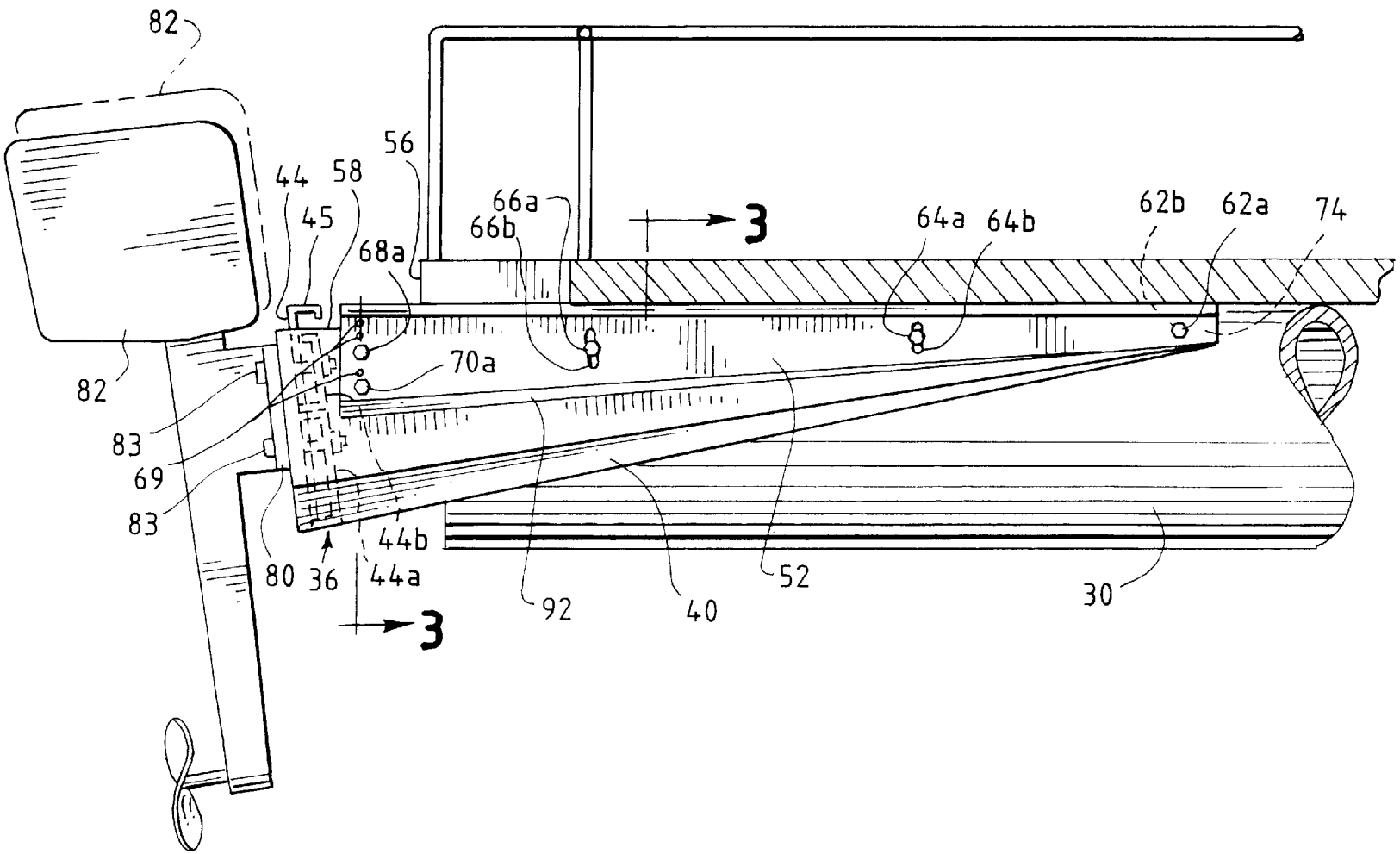
FIG. 2 is a sectional view taken generally along line 2—2 of FIG. 1, with an outboard motor installed.

FIG. 2 illustrates the engine mount 36 beneath the watercraft 20. The rail 52 is connected to the body 40 by five bolted connections 62, 64, 66, 68, 70. An end plate 74 substantially closes a front end (bow end) of the mount body 40. A motor plate 80 supports an outboard motor 82. The motor plate 80 is bolted to the engine-mounting wall 44 using bolts 83. The mounting wall 44 includes a top channel portion 45 which reinforces the top free edge of the wall 44 and also provides a guiding retainer for a fuel line, control cables or other like devices. Two inside reinforcing channels 44*a*, 44*b* are disposed facing against the inside surface of the mounting wall 44. The lower channel 44*a* is welded to the body 40. The upper channel 44*b* can be held to the wall 44 by the bolts 83 which penetrate through the wall 44 and a respective channel 44*a*, 44*b*. The channels 44*a*, 44*b* provide additional strength to the wall 44.

The bolted connection 62 includes a bolt 62*a* penetrating a circular hole 62*b*. The connections 64, 66 include bolt 64*a*, 66*a* each penetrating through a slot 64*b*, 66*b* respectively, which allows for rotation of the body 40 about the bolted connection 62 during adjustment. Although three connections 62, 64, 66 are shown, it is also encompassed by the invention to use a different number of connections such as one or more than three, depending on the requirements of a particular design.

The bolted connections 68, 70, include bolts 68*a*, 70*a*, that penetrate through two holes selected from a plurality of holes 69, spaced at different elevations. The holes 69 are arranged along a circle having its center point at the connection 62. With the connections 62, 64, 66 loosened, and before the bolts 68*a*, 70*a* are installed, by pivoting the body 40 about the connection 62, different holes 69 can be selected to change or adjust the elevation of the mounting wall 44. In this regard the elevation of the motor 82 can be changed as shown dashed in FIG. 2.

After adjustment, all the connections 62, 64, 66, 68, 70 can be tightened. Although two bolts 69*a*, 70*a* are shown, a different number of bolts can be used such as one or more than two, depending on the requirements of a particular design. Although a plurality of holes 69 are shown, it is also encompassed by the invention that the holes 69 are replaced by a curved slot arranged on a circular path having its center on the connection 62.

Figure 3:
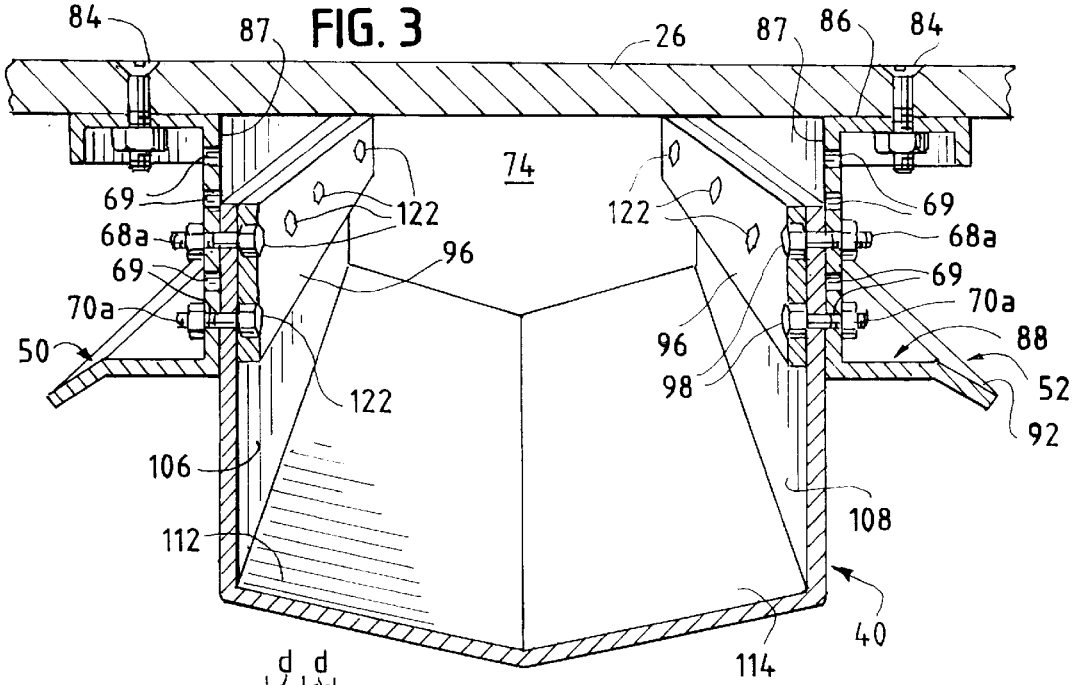
FIG. 3 is an enlarged sectional view taken generally along lines 3—3 of FIG. 2.

The connections 68, 70 are illustrated in FIG. 3. The bolts 68*a*, 70*a* are inserted through two selected holes of the plurality of holes 69. The rails are substantially channel-shaped in cross-section, having a continuous top flange 86, a web 87 and a bottom flange 88. The rails 50, 52 are connected to the deck 26 by a plurality of longitudinally spaced bolted connections 84, extending through the top flange 86 of the rails, respectively. Alternatively, the rails can be connected to the deck by brackets and/or by welding. The bottom flange 88 has a downturned end portion or deflector lip 92 which acts as a splash guard. The deflector lip 92 helps to keep water out of the engine mount body 40. The body 40 includes retainer plates 96 which have hexagonal holes for receiving, and restricting rotation of, hexagonal bolt heads 98 of the fasteners 68, 70. Thus, the bolts can be loosened from the outside without the need to grip the bolt heads 98 with a tool to prevent rotation of the bolt heads.

The retainer plates 96 are each respectively welded to inside surfaces of sidewalls 106, 108 of the body 40. The retainer plate 96 is also preferably composed of aluminum and is 0.250 inches thick. The sidewalls 106, 108 are connected to angled bottom walls 112, 114. Together, the walls 106, 108, 112, 114 form a generally U-shaped cross-section of the body.

Figure 4:
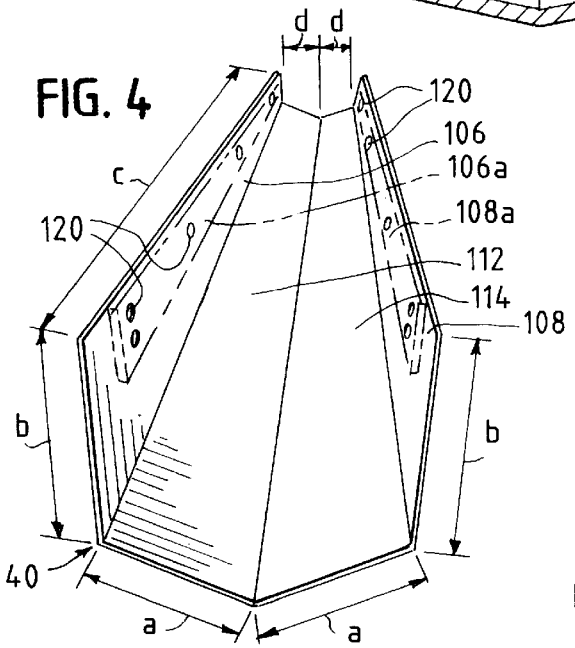
FIG. 4 is a perspective view of a body portion of the engine mount of FIG. 1.

FIG. 4 illustrates the body 40 having side walls 106, 108 and bottom walls 112, 114. The four walls 106, 108, 112, 114 can be formed by bending a single sheet of aluminum. The sheet is preferably 0.170 inches thick. Each of the side walls 106, 108 has a region 106*a*, 108*a* (shown in phantom) which receives one retainer plate 96 attached thereto by welding. Each sidewall 106, 108 includes a plurality of spaced apart circular holes 120 for receiving the shank of bolts 62*a*, 64*a*, 66*a*, respectively.

Figure 6:
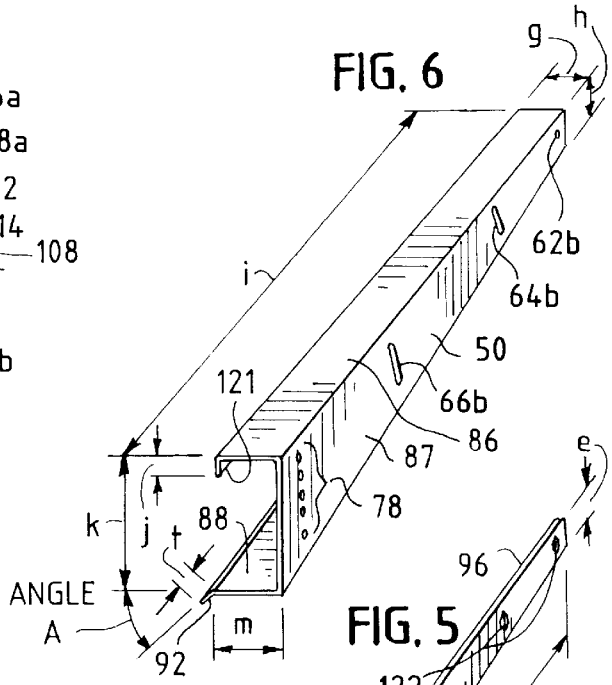
FIG. 6 is a perspective view of one of two braces which are each attached to a region of the body portion of FIG. 4.
Figure 5:
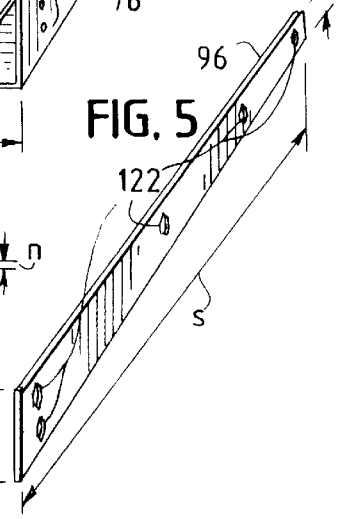
FIG. 5 is an elevational view of one of two retainer plates, to be attached to portions of the body portion shown in FIG. 4.

FIG. 6 illustrates one of the rails 50. The rail 52 is mirror image identical. The rail 50 is configured in a channel shape having a tapering height from stem end to bow end. The top flange 86 also includes a downturned flange lip 121 for added rigidity. The rail is also preferably composed of aluminum and is 0.170 inches thick. The rail 50 includes the plurality of holes 69 arranged substantially vertically along the circular arc having its center at the connection hole 62*b*. The bolts 68*a*, 70*a* are arranged to also be along the same circular arc, such as to be positionable within select ones of the holes 69, for adjusting the elevation of the engine-mounting wall 44. The slots 64*b*, 66*b* are arranged extending along circular arcs also having centers at the centerline of the connection hole 62*b*. The bottom flange 88 of the rail 50 includes the angled lip 92 which is turned at an angle A, preferably being about 55 degrees at the stern end.

Figure 7:
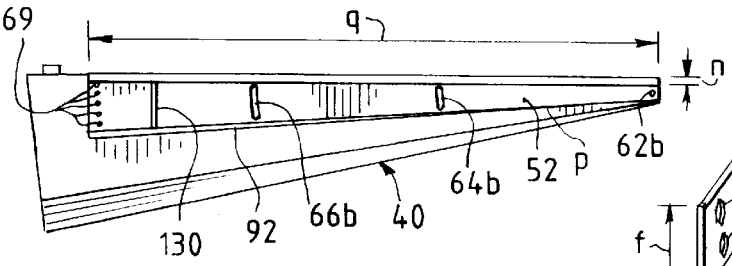
FIG. 7 is an enlarged elevational view of the engine mount of FIG. 1, separated from the watercraft.

FIG. 7 illustrates the body 40 and the rail 52 assembled, but shown without bolts for clarity of view. The angle A of the lip 92 is gradually straightened out toward a front of the rail 52, i.e., the angle A gradually diminishes to zero degrees, wherein the lip blends into the rest of the bottom flange 88. The lip 92 blends into the rest of the bottom flange 88, at a point p about midway between the slot 64*b* and the hole 62*b*. A reinforcing, rectangular gusset plate 130 is welded to the upper and lower flanges 86, 88 and to the web 89 to reinforce the rail adjacent to the bolted connections 68, 70.

The mount 36 is tapered from its stem end toward its bow end, tapered both in plan and in elevation, to provide a streamlined profile to reduce splashing and water resistance or drag as the watercraft moves through the water. In this regard the preferred dimensions (in inches), as indicated in FIGS. 4 through 7, are: a=9¼; b=13½; c=74; d=4; e=2; f=4¾; g=3¼; h=3½; i=68; j=15/16; k=8¼; m=3; n=15/16; q=68; r=15½; s=71; t=1.

Figure 8:
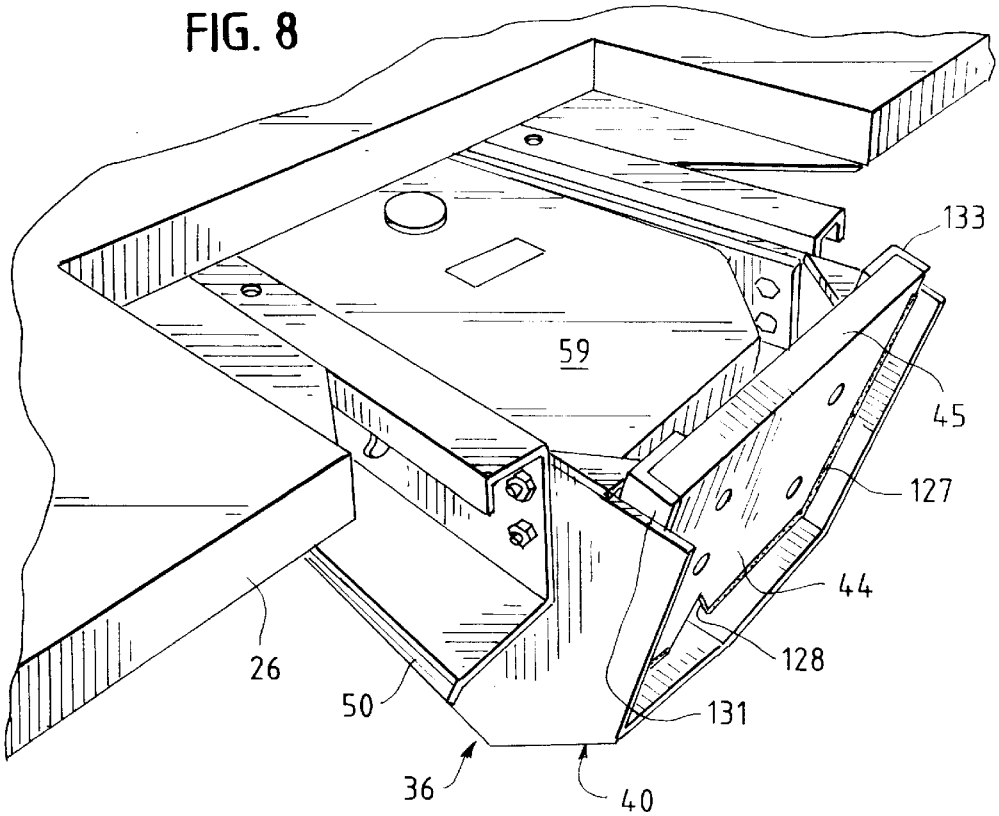
FIG. 8 is an enlarged, fragmentary, top perspective view of a stern end of the mount separated from the watercraft, as shown in FIG. 7.

FIG. 8 illustrates the mount 36 with the fuel tank 59 within the body 40. The mounting wall 44 is welded all around with a bead 127 to the sidewalls 106, 108, and the bottom walls 112, 114. A small gap 128 in the weld at the intersection of the bottom walls provides a drain for water which enters the body 40. The channel portion 45 extends above the side walls 106, 108 and is welded thereto via prone L-shaped pieces 131, 133.

Figure 9:
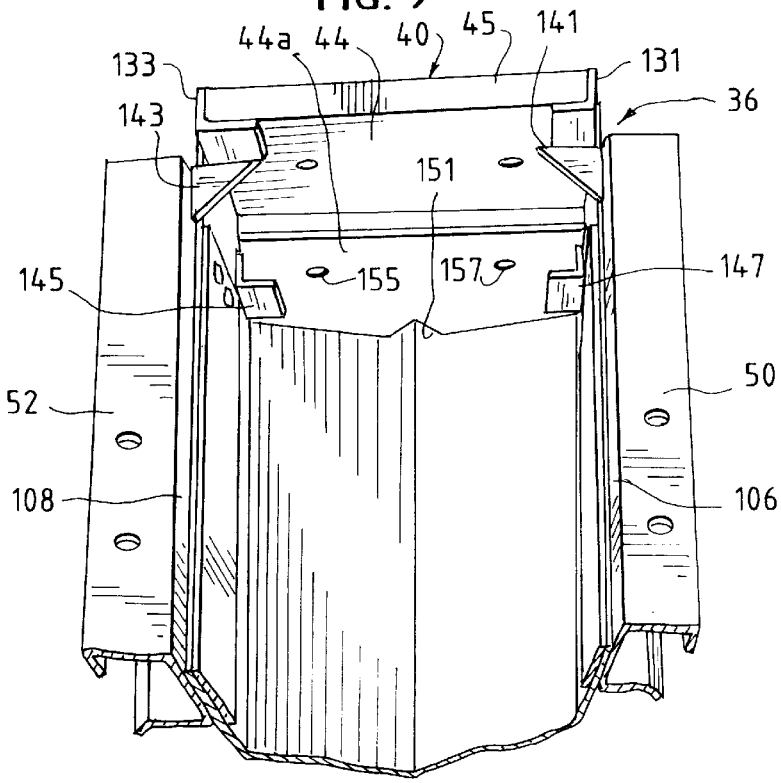
FIG. 9 is an enlarged, fragmentary, rear perspective view of the watercraft shown in FIG. 1.

FIG. 9 illustrates the inside of the body 40 at the stem end. The L-shaped pieces 131, 133 are further connected to the sidewalls 106, 108 by horizontal triangular reinforcing plates 141, 143. The channel 44*a* is connected to, and overlies, a bottom half of the inside of the mounting wall 45. Two L-shaped spacers 145, 147 protrude from the inside wall 145 toward the bow end and act to retain the fuel tank 59. A triangular notch 151 through the channel 44*a* provides fluid communication with the gap 128 for draining the body 40. Bolt holes 155, 157 are used for mounting the outboard motor. The upper channel 44*b* is not shown in FIG. 9 but is substantially similar to the lower channel 44*a*.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An adjustable engine mount for a boat, comprising:

a first rail and a second rail mounted to a bottom of a boat and elongated in a substantially longitudinal direction of said boat;

an elongated attachment member having first and second ends with a plurality of attachment regions disposed therebetween, said attachment regions attaching said attachment member to said rails, the attachment member having a vertical adjustability with respect to said rails by adjustment of said attachment regions;

an engine-mounting member carried adjacent to one of the ends, said vertical adjustability operable to adjust the elevation of said engine-mounting member within a range of operable elevations; and wherein the attachment member comprises four planar elongated, tapered members and exhibits a substantially U-shaped cross section.

2. A mount as in claim 1 wherein the mounting member extends from the attachment member and is adapted to receive an engine thereon.

3. A mount as in claim 1 wherein the plurality of attachment regions comprises a plurality of openings defined in the attachment member.

4. A mount as in claim 1 wherein the plurality of attachment regions comprise a plurality of protrusions extending from the attachment member.

5. A watercraft, comprising:

a platform for carrying people;

a pair of pontoons arranged beneath the platform for supporting the platform above a water line;

a pair of rails arranged beneath, and supported by, the platform between the pontoons, said rails elongated along the longitudinal direction of said platform and extending substantially horizontally;

an engine mount assembly arranged between the pontoons, said engine mount assembly including an elongated body pivotally connected at a front end thereof to said rails and connected at a rear end thereof at a selected vertical position to said rails, and an engine-mounting wall connected to said body at said rear end; and an outboard motor mounted to said engine-mounting wall.

6. The watercraft according to claim 5, wherein said body is connected to said rails at said rear end, one of said rails and said body having a plurality of selectable holes and a respective other of said rails and said body having at least one protrusion insertable into one of said selectable holes.

7. The watercraft according to claim 5, wherein said body is substantially hollow, and further comprising a fuel tank carried within said body.

8. A watercraft, comprising:

a platform for carrying people;

a pair of pontoons arranged beneath the platform for supporting the platform above a water line;

a pair of rails arranged beneath, and supported by, the platform between the pontoons;

an engine mount assembly arranged between the pontoons, said engine mount assembly including an elongated body pivotally connected at a front end thereof to said rails and connected at a rear end thereof at a selected vertical position to said rails, and an engine-mounting wall connected to said body at said rear end;

an outboard motor mounted to said engine-mounting wall; and a pair of splash deflectors each respectively extending along one of said rails, said splash deflectors comprising rearward-progressively downturned lips.

9. A watercraft, comprising:

a platform for carrying people;

a pair of pontoons arranged beneath the platform for supporting the platform above a water line;

pair of rails arranged beneath, and supported by, the platform between the pontoons;

an engine mount assembly arranged between the pontoons, said engine mount assembly including an elongated body pivotally connected at a front end thereof to said rails and connected at a rear end thereof at a selected vertical position to said rails, and an engine-mounting wall connected to said body at said rear end;

an outboard motor mounted to said engine-mounting wall; and wherein said body comprises a substantially U-shaped cross-section and said rails comprise prone, substantially U-shaped cross sections.

10. A watercraft comprising:

platform for carrying people;

pair of pontoons arranged beneath the platform for supporting the platform above a water line;

a pair of rails arranged beneath, and supported by, the platform between the pontoons;

an engine mount assembly arranged between the pontoons, said engine mount assembly including an elongated body pivotally connected at a front end thereof to said rails and connected at a rear end thereof at a selected vertical position to said rails, and an engine-mounting wall connected to said body at said rear end;

an outboard motor mounted to said engine-mounting wall; and wherein said rails extend along a length of said watercraft substantially equal in length to said body.

11. A watercraft, comprising:

a platform for carrying people;

a pair of pontoons arranged beneath the platform for supporting the platform above a water line;

a pair of rails arranged beneath, and supported by, the platform between the pontoons;

an engine mount assembly arranged between the pontoons, said engine mount assembly including an elongated body pivotally connected at a front end thereof to said rails and connected at a rear end thereof at a selected vertical position to said rails, and an engine-mounting wall connected to said body at said rear end;

an outboard motor mounted to said engine-mounting wall; and wherein said body is adjustably connected to said rails at a position intermediate said front and rear ends.

12. A watercraft, comprising:

a platform for carrying people;

a pair of pontoons arranged beneath the platform for supporting the platform above a water line;

an engine mount assembly arranged between the pontoons, said engine mount assembly including an elongated body having a front end and a rear end, and an engine-mounting wall connected to said body at said read end of said body;

an outboard motor mounted to said engine-mounting wall;

a first rail extending between said rear end and said front end of said body, said first rail connected to said platform, said body pivotally connected to said first rail at said front end and selectively fastened at said rear end to adjust an elevation of said engine-mounting wall;

a second rail extending between said rear end and said front end of said body, said second rail connected to said platform, said body pivotally connected to said second rail at said front end and selectively fastened at said rear end to adjust an elevation of said engine-mounting wall, said first and second rails arranged on opposite sides of said body; and wherein said body comprises a substantially U-shaped cross-section and said rails comprise prone, substantially U-shaped cross-sections.

13. A watercraft, comprising:

a platform for carrying people;

a pair of pontoons arranged beneath the platform for supporting the platform above a water line;

a pair of rails arranged beneath, and supported by, the platform between the pontoons, said rails elongated along the longitudinal direction of said platform and extending substantially horizontally;

an engine mount assembly arranged between the pontoons, said engine mount assembly including an elongated body pivotally connected at a front end thereof to said rails and connected at a rear end thereof at a selected vertical position to said rails, and an engine-mounting wall connected to said body at said rear end.

14. The watercraft according to claim 13, wherein said body is connected to said rails at said rear end, one of said rails and said body having a plurality of selectable holes and a respective other of said rails and said body having at least one protrusion insertable into one of said selectable holes.

* * * * *